United States Patent [19]

Kanemitsu

[11] 4,313,323

[45] Feb. 2, 1982

[54] METHOD FOR MANUFACTURING POLY-V PULLEYS

[75] Inventor: Yukio Kanemitsu, Kobe, Japan

[73] Assignee: Goshi Kaisha Kanemitsu Doko Yosetsu-sho, Akashi, Japan

[21] Appl. No.: 145,100

[22] Filed: Apr. 30, 1980

[30] Foreign Application Priority Data

Sep. 4, 1979 [JP] Japan ..... 54/113820

[51] Int. Cl.[3] ..... B21H 1/00

[52] U.S. Cl. ..... 72/84; 29/159 R

[58] Field of Search ..... 72/84, 102, 105, 106, 72/108; 29/159 R, 159.1; 113/116 D

[56] References Cited

U.S. PATENT DOCUMENTS 3,457,751 7/1969 Lindeman ..... 72/105

3,953,995 5/1976 Haswell et al. ..... 72/105

3,977,264 8/1976 Sproul ..... 29/159 R

*Primary Examiner*—Lowell A. Larson

*Attorney, Agent, or Firm*—Steele, Gould & Fried

[57] ABSTRACT

A method for manufacturing a poly-V pulley comprising pre-forming the flange wall of a cup-shaped blank to have a corrugated cross section having a series of valleys formed around the outer circumference thereof, axially compressing the corrugated flange wall of the blank, and pressing a rotary forming roller against valleys formed around the outer circumference of the flange wall to form each of valleys to a predetermined V-groove. The axially compressing process is carried out keeping respective outer circumference of axially movable auxiliary forming rollers inserted into their corresponding valleys formed around the outer circumference of the flange wall of the blank.

8 Claims, 10 Drawing Figures

METHOD FOR MANUFACTURING POLY-V PULLEYS

BACKGROUND OF THE INVENTION (a) Field of the invention

The present invention relates to a method for manufacturing a poly-V pulley of metal plate having a series of V-grooves formed around the outer circumferance of an annular flange wall thereof with a predetermined pitch between grooves.

(b) Brief description of the prior art

Various kinds of poly-V pulleys have been developed to be used for poly-V belts recently developed instead of V belts.

U.S. Pat. No. 3,977,264 discloses a technique of manufacturing a poly-V pulley using a metal plate blank. It can be summarized as follows. After a one-piece cup-shaped metal blank is pre-molded to form a series of corrugation-like valleys around the outer circumference of an annular flange wall adjacent to the open end thereof, the flange wall is axially compressed, and then a rotary forming roller is pressed into each of the valleys to form predetermined V-grooves around the outer circumference thereof.

The manufacturing technique disclosed by the above-mentioned U.S. patent causes a problem particularly in the squeezing and compressing process of the flange wall. Though the U.S. patent discloses a step in which the flange wall is compressed by upper and lower pressing forms keeping inner and outer surfaces of the flange wall enclosed by fixed wall faces of inner and outer forms, it is difficult for this step to allow the flange wall to be evenly or regularly folded in zigzag manner. Namely, though the flange wall has been pre-molded to have a corrugated cross section, it is seldom seen that crests and valleys of the corrugation are evenly or regularly bent by the compression due to upper and lower pressing forms, but they are unevenly or irregularly bent in most cases. Therefore, the pitch between valleys formed on the outer circumference of the flange wall becomes irregular, thus making the subsequent rotary roller pressing operation difficult. In addition, the uneven or irregular bending of the corrugation causes crests and valleys thereof to be excessively pressed against fixed wall faces of inner and outer forms enclosing the flange wall, thus making it difficult to pull off the compressed corrugated cup-shaped blank from forms.

SUMMARY OF THE INVENTION

It is therefore an object of the present invention to provide a method for manufacturing a poly-V pulley capable of preventing the flange wall from being irregularly bent at the time of axially compressing the flange wall, forming V-grooves accurately, and eliminating the difficulty in pulling the compressed corrugated cup-shaped blank off the forms.

Another object of the present invention is to provide a method for manufacturing a poly-V pulley capable of causing auxiliary forming rollers to be accurately operated in a simple manner so as to prevent the flange wall from being irregularly bent.

A further object of the present invention is to provide a method for manufacturing a poly-V pulley capable of effectively preventing the flange wall from being irregularly bent using auxiliary solid forming rollers, each having a sufficient thickness, even if the pitch between adjacent V-grooves is small.

These and other objects as well as merits of the present invention are attained by a new method for manufacturing poly-V pulleys. According to the poly-V pulley manufacturing method of the present invention comprising pre-forming the flange wall of a cup-shaped blank adjacent the open end thereof so as to form a corrugated cross section having a series of valleys around the outer circumference of the flange wall, axially compressing the corrugated flange wall of the cup-shaped blank, and forming predetermined V-grooves by pressing rotary forming rollers into valleys formed around the outer circumference of the flange wall, the compression process is attained keeping the outer circumference of each of axially-movable auxiliary forming rollers inserted into each of valleys formed around the outer circumference of the flange wall of the cup-shaped blank, thus forceably preventing the corrugated flange wall of the cup-shaped blank from being irregularly bent at the time of the compression forming process. Each of auxiliary forming rollers is axially movably attached to a shaft arranged parallel to the center axis of the cup-shaped blank, thus allowing auxiliary forming rollers to smoothly follow the shift of valleys caused at the time of the axially compressing process. In addition, two shafts are arranged so as not to interfere with each other and to be parallel to the center axis of the cup-shaped blank. Auxiliary forming rollers intended to be inserted into uneven-numbered valleys of the flange wall are attached to one of the shafts. Auxiliary forming rollers intended to be inserted into even-numbered valleys are attached to the other shaft. Accordingly, a sufficient axial movement of auxiliary forming rollers can be guaranteed even if each of the auxiliary forming rollers is made thick.

DETAILED DESCRIPTION OF THE PREFERRED EMBODIMENT

Figure 1:
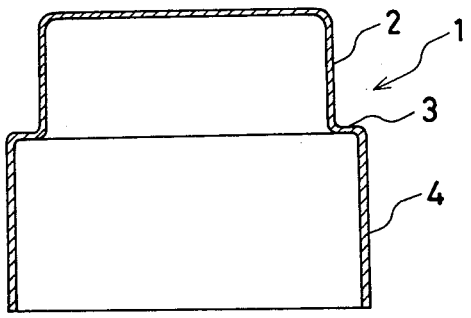
FIG. 1 is a sectional view showing a cup-shaped blank.

FIGS. 1 through 7 show an embodiment of the present invention. According to the embodiment a metal plate is formed by press process or the like to a cup-shaped blank 1 shown in FIG. 1. The cup-shaped blank 1 comprises a cup portion 2 having a smaller diameter, a stepped portion 3, and a flange wall 4 having a larger diameter and continuous via the stepped portion 3 from the cup portion 2.

Figure 2:
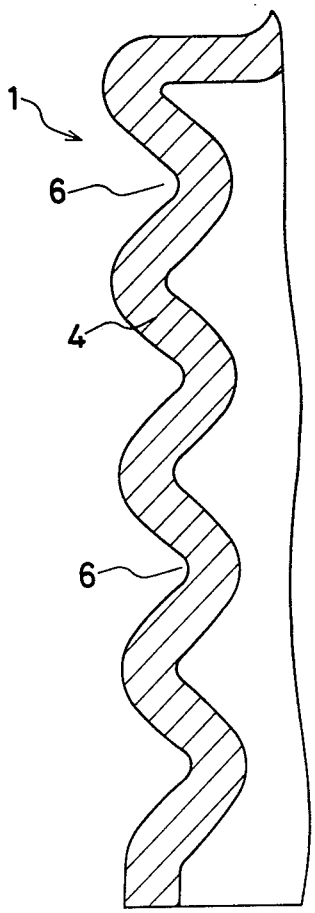
FIG. 2 is a sectional view showing the pre-formed flange wall of the cup-shaped blank.

The flange wall 4 of the cup-shaped blank 1 is preformed to have a corrugated section provided with a series of valleys 6 around the outer circumference of the flange wall 4 as shown in FIG. 2.

Figure 3:
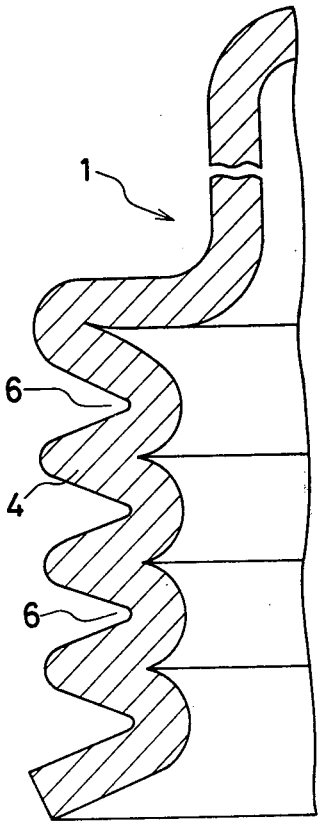
FIG. 3 is a sectional view showing the axially compressed flange wall of the cup-shaped blank.

The corrugated flange wall 4 is axially compressed in zigzag manner as shown in FIG. 3.

Figure 4:
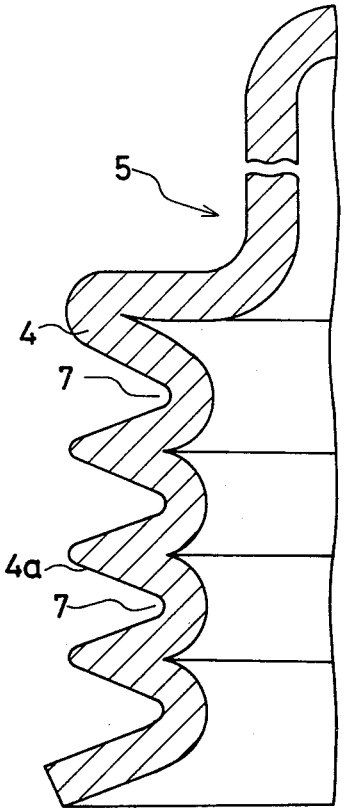
FIG. 4 is a sectional view showing the flange wall of a finished poly-V pulley.

Finally valleys 6 of the folded flange wall 4 are subjected to the operation of a rotary forming roller to form predetermined V-grooves 7, thus providing a desired poly-V pulley 5 shown in FIG. 4.

Each of above-mentioned processes will be now described in more detail.

Figure 5:
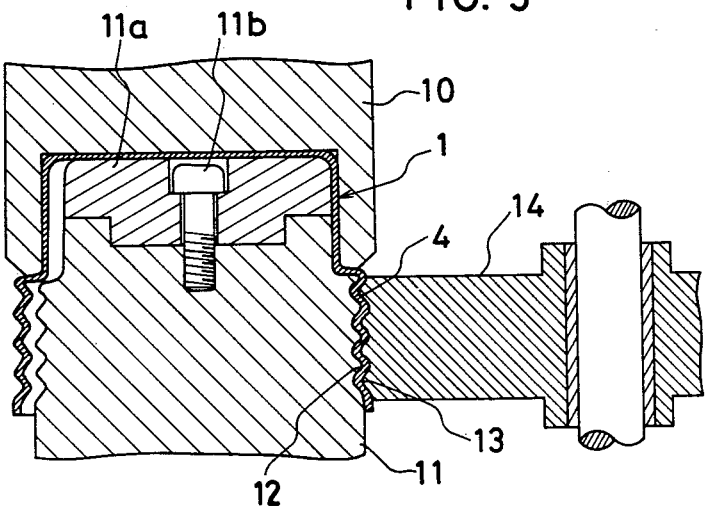
FIG. 5 is a sectional view showing the final stage of the pre-forming process.

As shown in FIG. 5, the pre-forming of the flange wall 4 of the cup-shaped blank 1 is achieved in such a way that the cup-shaped blank 1 is supported between a pair of upper and lower pillar-shaped rotary supports 10 and 11 and kept rotating around the center axis while a pair of inner and outer pre-forming rolling faces 12 and 13 are pressed against the flange wall 4 from both sides thereof. In short, the lower rotary support 11 provided with the inner pre-forming rolling face 12 of a smaller diameter around the outer circumference thereof is eccentrically rotated so as to urge the inner pre-forming rolling face 12 thereof against and along the inner circumference of the flange wall 4. A pre-forming roller 14 provided with the outer pre-forming rolling face 13 around the outer circumference thereof is pressed against the flange wall 4 from the outer side of the flange wall 4, so that the flange wall 4 is pressed between rolling faces 12 and 13 to have a corrugated cross section having a series of valleys 6 around the outer circumference thereof. On the top of the lower rotary support 11 is detachably mounted by means of a bolt 11*b* a top member 11*a* made of non-crystalline metal such as cast metal and ultra-hard alloys, and the upper face of the top member 11*a* is arranged to slidably contact the inner face of the bottom of the cup-shaped blank 1. If the face of the lower rotary support 11 made of crystalline metal such as die steel is arranged to directly slidably contact the cup-shaped blank 1 made of crystalline metal such as iron plate, biting will be caused between slidably contacted faces to leave abrasion on the inner face of the cup-shaped blank 1. However, this disadvantage can be eliminated by mounting the top member 11*a* of non-crystalline metal on the top of the lower rotary support 11 as described above.

Figure 6:
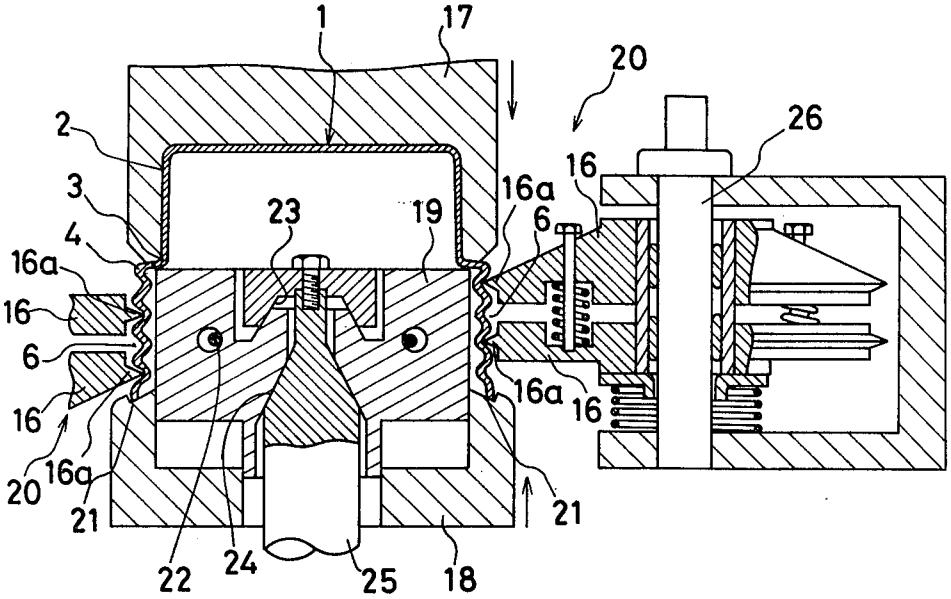
FIG. 6 is a sectional view showing the primary stage of the axially compressing process.
Figure 7:
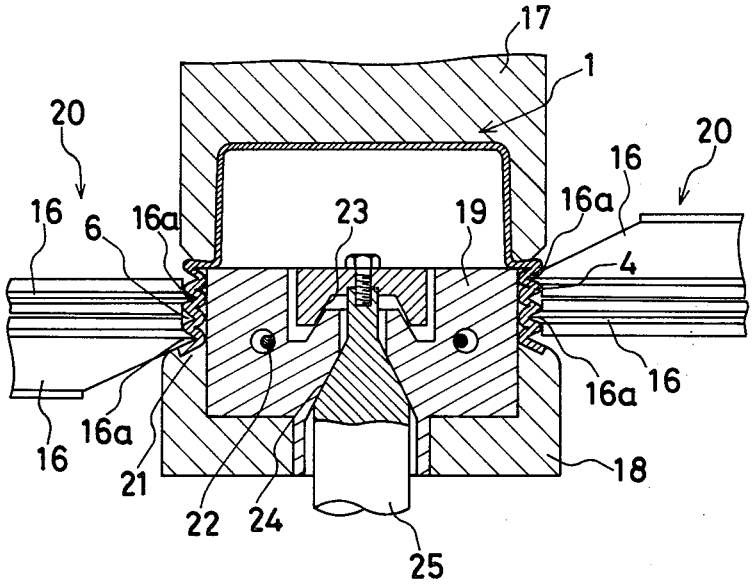
FIG. 7 is a sectional view showing the middle stage of the axially compressing process.
Figure 8:
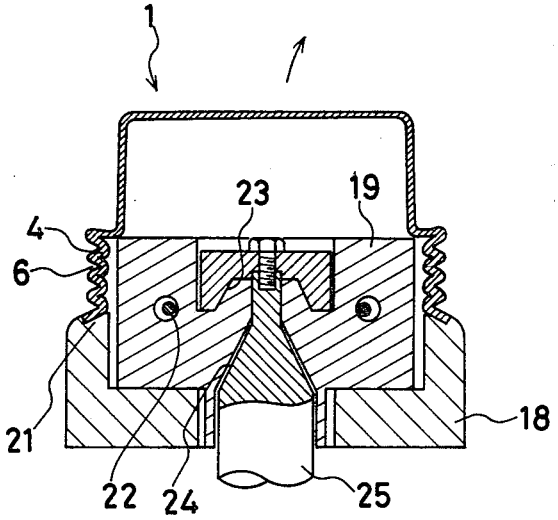
FIG. 8 is a sectional view showing the final stage of the axially compressing process.

The compression forming of the corrugated flange wall 4 is attained by inserting each of outer circumferences 16*a* of axially movable auxiliary forming rollers 16 into each of valleys 6 as shown in FIGS. 6 through 8. Namely, there are used in this process a pair of upper and lower rotary compression forms 17 and 18 for compressing the flange wall 4 from both ends thereof, an inner form 19 arranged adjacent the inner face of the flange wall 4, and an auxiliary forming roller device 20 having auxiliary forming rollers 16. The upper rotary compression form 17 serves to compress the cup portion 2 and stepped portion 3 of the cup-shaped blank 1 from outside. The lower rotary compression form 18 having a recess serves to compress the flange wall 4 keeping the open end rim of the flange wall 4 received in a stepped portion 21 formed on the upper face of the form 18. The divided cylindrical inner form 19 is inserted into the recess of the lower rotary compression form 18 and supported therein so as to freely enlarge or reduce the diameter thereof radially and to freely rise up and down in the vertical direction. Namely, the inner form 19 is urged by means of a ring spring 22 in the direction in which the diameter of the form 19 is reduced, and arranged to be radially enlarged or reduced in the diameter thereof and to be lifted or lowered in the vertical direction by means of an axially movable driving shaft 25, which has a pair of reversely tapered portions 23 and 24. The outer circumference of the inner form 19 serves as a fixed wall face for supporting from inside the flange wall 4 at the time of the compression forming process. The auxiliary forming roller device 20 comprises a shaft 26 parallel to the center axis of upper and lower rotary compression forms 17 and 18, and a plurality of auxiliary forming rollers 16 attached to the shaft 26 so as to be parallel to one another and freely slidable by means of springs. Each of outer circumferences 16*a* of auxiliary forming rollers 16 is formed to have a triangular cross section similar to that of the V-groove 7 obtained at the time when the final forming process is finished. Two shafts 26, one of which is omitted in the drawings, are arranged in respective positions not interfering with each other and to one of shafts 26 are attached two pieces of auxiliary forming rollers 16 which are inserted into uneven-numbered valleys 6, that is, first and third valleys 6, while to the other two pieces of auxiliary forming rollers 16 which are inserted into even-numbered valleys 6, that is, second and fourth valleys 6. The auxiliary forming roller 16 intended to be inserted into the fourth valley 6 is reverse in shape to the auxiliary forming roller 16 intended to be inserted into the first valley 6.

The pre-formed cup-shaped blank 1 is set between upper and lower rotary compression forms 17 and 18 at the time of the compression forming process keeping the inner form 19 lifted as shown in FIG. 6. In short, the blank 1 is rotated with the stepped portion 3 thereof held between the upper rotary compression form 17 and the inner form 19 as well as with the flange wall 4 thereof compressed from both ends thereof by upper and lower rotary compression forms 17 and 18. This is performed keeping respective outer circumferences 16*a* of auxiliary forming rollers 16 inserted into their corresponding valleys 6. The inner form 19 is progressively lowered into the recess of the lower rotary compression form 18 as the compression process progresses, and the flange wall 4 is folded in zigzag manner, as shown in FIG. 7, to follow the shape of each of outer circumferences 16*a* of auxiliary forming rollers 16 inserted into their corresponding valleys 6. In short, valleys 6 are limited in the transformation thereof by auxiliary forming rollers 16 and formed regularly to have a predetermined pitch therebetween. As described above, the inner face of the flange wall 4 is supported and limited in the transformation thereof at the same time by the inner form 19 which serves as a fixed wall face contacted with the inner face of the flange wall 4. After the compression process, auxiliary forming rollers 16 are retreated backward, and the driving shaft 25 is lowered to cause the diameter of the inner form 19 to be radially reduced by the combined action of the tapered portion 23 and the spring 22, so that the inner face of the flange wall 4 is parted from the inner form 19 leaving the cup-shaped blank 1 ready for being removed.

Figure 9:
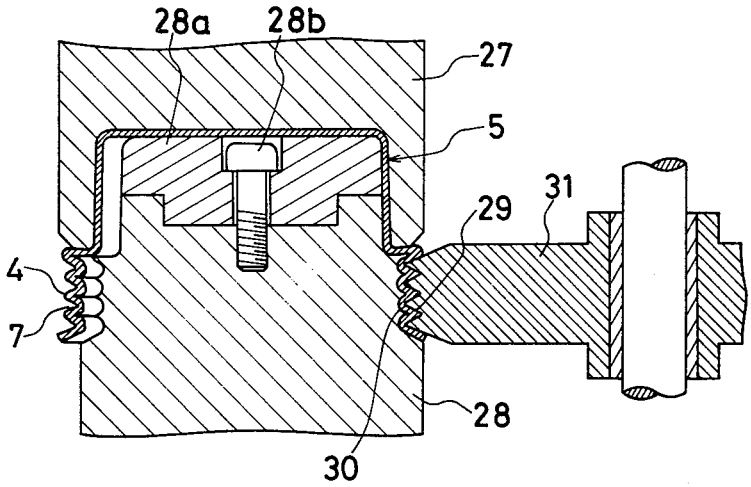
FIG. 9 is a sectional view showing the final stage of the finishing forming process.

The final process using the rotary forming roller is achieved, as shown in FIG. 9, in such a way that the cup-shaped blank 1 is supported between a pair of upper and lower rotary finishing supports 27 and 28 and rotated around the center axis thereof with the zigzag-like folded flange wall 4 pressed from outside by a poly-V groove finishing rolling face 29 as well as from inside by a receiving rolling face 30. In short, the lower rotary support 28 having the receiving rolling face 30 of smaller diameter formed around the outer circumference thereof is rotated eccentrically relative to the cup-shaped blank 1 so as to cause the receiving rolling face 30 to contact the inner face of the flange wall 4. On the other hand, a rotary finishing forming roller 31 having the poly-V groove finishing rolling face 29 formed around the outer circumference thereof, said rolling face 29 having crests for limiting the pitch between V-grooves, is pressably operated from outside against the flange wall 4 with crests of the rolling face 29 inserted into their corresponding valleys 6 of the flange wall 4. Accordingly, the flange wall 4 is formed by the final process to have a series of predetermined poly-V grooves around the outer circumference thereof. On the top of the lower rotary support 28 is detachably mounted by means of a bolt **28*b* a top member 28*a* made of non-crystalline metal such as cast metal and ultra-hard alloys and the upper face of the top member 28*a* is arranged to slidably contact the inner face of the bottom of the blank 1**.

According to the poly-V pulley manufacturing method of the present invention as described above, the compression forming process is achieved keeping respective outer circumferences **16*a* of axially-movable auxiliary forming rollers 16 inserted into their corresponding valleys 6 formed around the outer circumference of the flange wall 4 of the cup-shaped blank 1, so that the flange wall 4 of the blank 1 can be prevented by auxiliary forming rollers 16 from being unevenly or irregularly transformed, that is, the flange wall 4 can be unevenly or regularly folded in zigzag manner. Therefore, pitches between valleys 6 of the flange wall 4** can be made equal, thus making it easy to carry out the subsequent final forming process using the rotary forming roller.

In addition, since the flange wall 4 is folded with regularity, crests and valleys of the corrugation are prevented from being excessively pressed against fixed wall faces of inner and outer forms enclosing the flange wall 4, thus making it easy to pull off the compressed corrugated cup-shaped blank 1 from forms.

Figure 10:
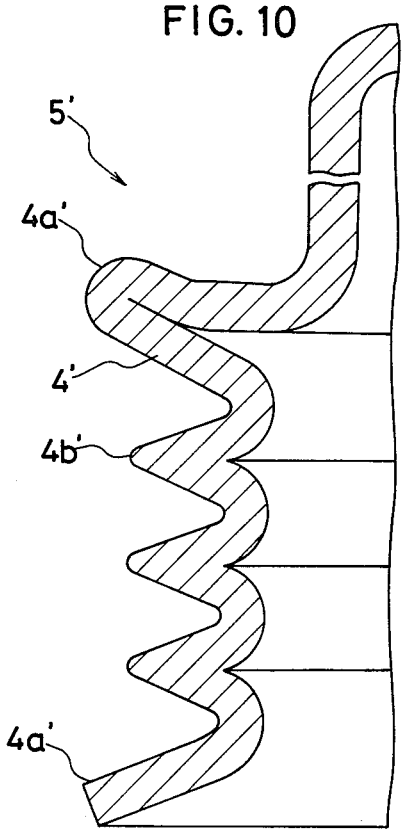
FIG. 10 is a sectional view showing the flange wall of another example of the poly-V pulley.

In the case of the above-mentioned embodiment of the present invention, crests **4*a* of the flange wall 4 of the poly-V pulley are made about same level as shown in FIG. 4, but it is apparent that poly-V pulleys manufactured according to the method of the present invention are not limited to this one and that various modifications can be attained, for example, both end crests 4*a*' of the flange wall 4' can be formed to have a larger diameter than those of other crests 4*b*' as shown in FIG. 10**.

What is claimed is:

1. An improved method for manufacturing a poly-v pulley for use with a poly-V belt, from a cup-shaped blank having a substantially cylindrical flange wall, comprising the steps of:

corrugating the flange wall to form a plurality of roughly dimensioned grooves, innermost edges of the grooves defining an inner surface of the flange wall;

axially compressing the corrugated flange wall between a pair of press forms; and, pressing a rotatable finishing roller into each of the compressed grooves of the corrugated flange wall to form a plurality of poly-V grooves of predetermined shape;

wherein the improvement comprises the steps of:

supporting the flange wall from the inside, during the axial compression, by an inner form having an even outer surface which contacts the inner surface of the flange wall;

supporting the flange wall from the outside during the axial compression by inserting an auxiliary roller into each of the grooves in the outer surface of the flange; and, allowing the auxiliary rollers to move axially so as to remain in engagement with the grooves as the flange wall is compressed.

2. A method for manufacturing a poly-V pulley for use with a poly-V belt, from a cup-shaped blank having a substantially cylindrical flange wall, comprising the steps of:

corrugating the flange wall to form a plurality of roughly dimensioned grooves, innermost edges of the grooves defining an inner surface of the flange wall;

axially compressing the corrugated flange wall between a pair of press forms, while simultaneously:

supporting the flange wall from the inside by an inner form having an even outer surface which contacts the inner surface of the flange wall;

supporting the flange wall from the outside by inserting an auxiliary roller into each of the grooves of the outer surface of the flange; and, allowing the auxiliary rollers to move axially so as to remain in engagement with the grooves as the flange wall is compressed; and, pressing a rotatable finishing roller into the compressed grooves of the flange wall to form a plurality of poly-V grooves of predetermined shape.

3. A method according to claim 2, wherein the auxiliary rollers are freely slidably attached to the shafts.

4. A method according to claims 2 or 3, wherein the auxiliary rollers are formed from a single roller having a plurality of roller ribs projecting outwardly therefrom.

5. A method according to claims 2 or 3, wherein the auxiliary rollers are individual members mounted on a common shaft.

6. A method according to claims 2 or 3, further comprising the step of rotating the press forms during the axial compression.

7. A method according to claims 4 or 5, wherein the auxiliary forming rollers are freely slidably attached to shafts disposed parallel to the central axis of the blank.

8. A method according to claims 4 or 5, further comprising the steps of:

dividing the grooves, as determined from the outer surface of the flange wall, into two sets of alternating valleys;

positioning two shafts parallel to the central axis of the blank so as not to interfere with each other;

attaching a plurality of auxiliary forming rollers on one of the shafts, each of the rollers being mounted so as to be inserted into one of the valleys of one of the alternating sets; and, attaching a further plurality of auxiliary forming rollers on the other of the shafts, each of the rollers being mounted so as to be inserted into the valleys of the other of the alternating sets.

* * * * *